United States Patent [19]

Hogg

[11] Patent Number: 5,074,814

[45] Date of Patent: Dec. 24, 1991

[54] SELF-CONTAINED OUTBOARD TWIN PROPELLER ADAPTOR

[76] Inventor: Alan J. Hogg, 833 SE. King Bay Dr., Crystal River, Fla. 32629

[21] Appl. No.: 678,456

[22] Filed: Apr. 1, 1991

[51] Int. Cl.[5] ..... B63H 5/06

[52] U.S. Cl. ..... 440/79; 440/900

[58] Field of Search ..... 440/77, 79, 80, 82, 440/83, 58, 900, 111, 112

[56] References Cited

U.S. PATENT DOCUMENTS

| | | | |
|---|---|---|---|
| 2,999,476 | 9/1961 | Johnson | 440/79 X |
| 3,072,090 | 1/1963 | Yarbrough | 440/62 |
| 3,954,083 | 5/1976 | Frostrom | 440/79 X |
| 4,678,439 | 7/1987 | Schlichthorst | 440/111 |
| 4,981,452 | 1/1991 | Grinde | 440/57 |

FOREIGN PATENT DOCUMENTS

| | | | |
|---|---|---|---|
| 23161 | of 1898 | United Kingdom | 440/75 |

*Primary Examiner*—Edwin L. Swinehart

*Attorney, Agent, or Firm*—H. Jay Spiegel

[57] ABSTRACT

Disclosed is a device designed to be mounted on the outdrive of an existing marine outboard motor and coupled to the drive shaft thereof with the existing propeller removed. The invention uses chain and sprockets to transfer power from the existing drive shaft to twin propeller shafts driving twin propellers. The device may easily be mounted onto the existing outdrive and may easily be removed therefrom for repairs, storage and restoration of single propeller drive.

4 Claims, 3 Drawing Sheets

SELF-CONTAINED OUTBOARD TWIN PROPELLER ADAPTOR

BACKGROUND OF THE INVENTION

The present invention relates to a self-contained outboard twin propeller adaptor. In the prior art, devices designed to convert power from a single shaft to plural propellers are known. The following prior art is known to Applicant:

U.S. Pat. No. 2,999,476 to Johnson discloses an outboard marine drive for an inboard engine of a boat. The device is designed to couple with the drive shaft of the inboard engine as it extends through the boat transom. This is different from the teachings of the present invention wherein the twin propeller adaptor mounts directly to the outdrive of an outboard engine and does not attach to the transom of the associated vessel.

U.S. Pat. No. 3,072,090 to Yarbrough discloses an outboard marine propulsion apparatus including twin propellers which mounts over the transom of a vessel and couples to the inboard drive shaft 11 of the vessel via a transmission 13 and upwardly extending drive shaft 14. Of course, this is different from the teachings of the present invention wherein a twin propeller adaptor attaches directly to the outdrive of an existing outboard motor.

U.S. Pat. No. 3,954,083 to Frostrom discloses a twin propeller stern drive mounted directly to the transom of a vessel and coupled to the drive shaft of an inboard engine. Again, the present invention differs from the teachings of Frostrom as contemplating attachment of a twin propeller adaptor directed to the outdrive of an existing outboard motor.

SUMMARY OF THE INVENTION

The present invention relates to a self contained outboard twin propeller adaptor. The present invention includes the following interrelated objects, aspects and features:

(A) In a first aspect, the present invention is intended to be attached to an existing outboard motor as mounted on the transom of a boat, which outboard motor includes a housing having an engine compartment and, depending therefrom, an elongated outdrive having an internal shaft communicating power from the engine to a drive shaft at the bottom of the outdrive.

(B) The present invention includes a housing designed to be mounted in any suitable manner about the bottom of the outdrive with the original propeller of the existing outboard motor removed.

(C) The present invention includes a centrally located sprocket set having a central opening designed to drivingly receive the drive shaft of the existing outboard motor. Two additional sprocket sets are contained within the housing and are drivingly connected to the central sprocket by two elongated endless chains.

(D) Idler sprockets are provided within the housing to provide chain tension to enable positive force transmission between the central sprocket set and the outside sprocket sets. Thus, when the central sprocket set is rotated via the existing drive shaft receiving power from the existing engine of the outboard motor, the outside sprocket sets will rotate in unison therewith.

(E) Each of the outside sprocket sets has a drive shaft attached thereto which is drivingly connected to a propeller mounted outside the housing. Thus, rotations of the sprocket sets will result in rotations of the propellers to drive the associated vessel.

As such, it is a first object of the present invention to provide a self-contained outboard twin propeller adaptor.

It is a further object of the present invention to provide such a device designed to attach to the outdrive of an existing outboard motor.

It is a still further object of the present invention to provide such a device using endless chains to transfer power from the existing drive shaft of the existing outboard motor to twin propellers.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
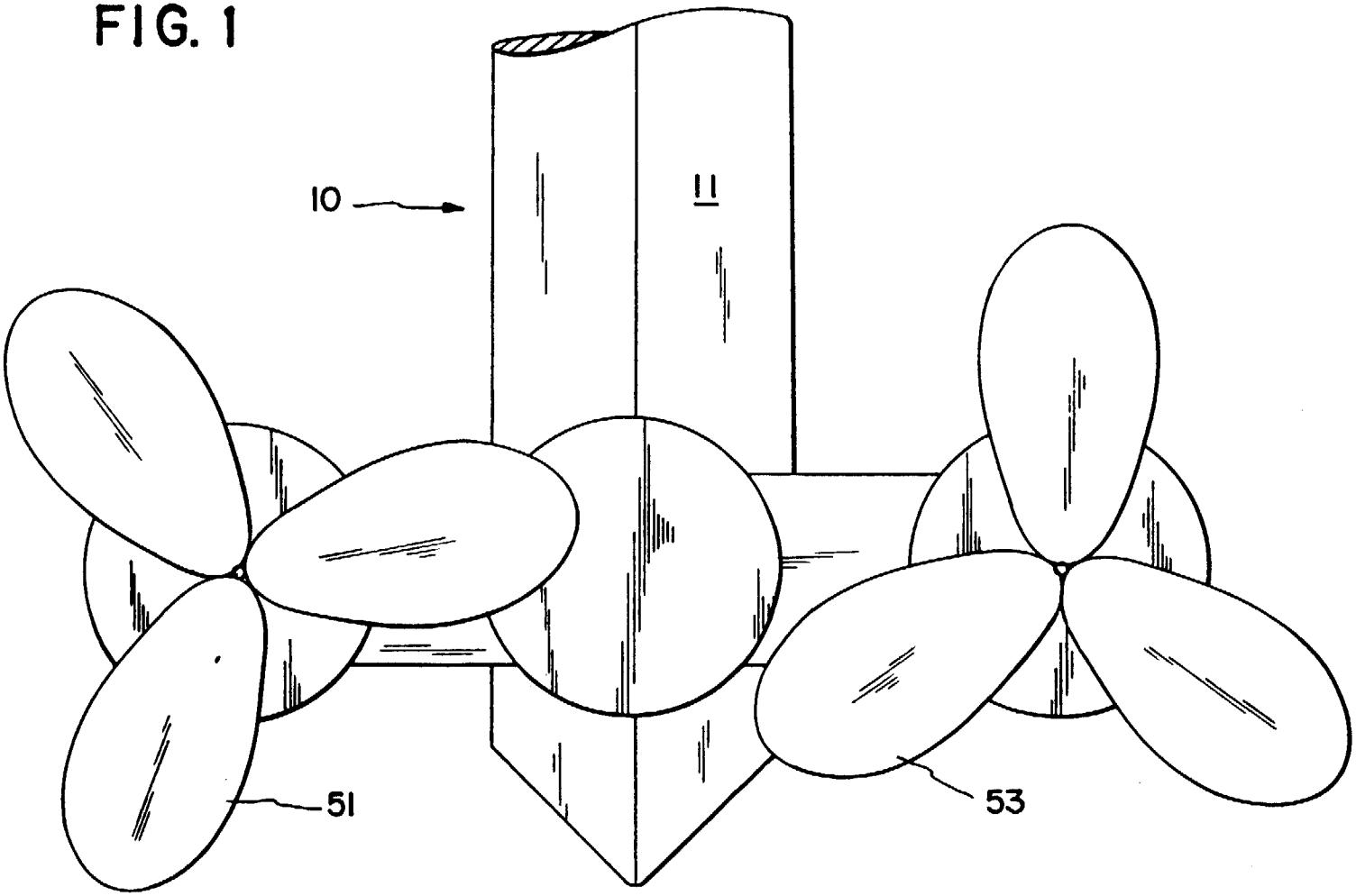
FIG. 1 shows a rear view of the inventive device.
Figure 3:
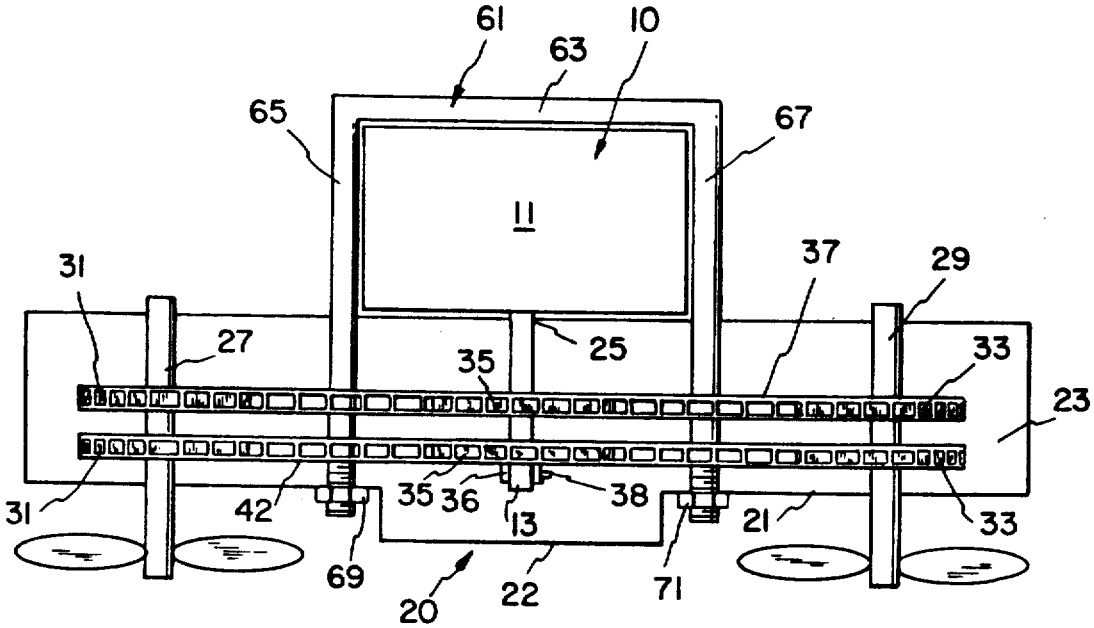
FIG. 3 shows a top view of the inventive device as coupled to the outdrive of an existing outboard motor.

With reference, first, to FIGS. 1 and 3, the outdrive of an existing outboard motor is generally designated by the reference numeral 10 and includes an elongated housing 11 and a drive shaft 13 which normally has attached thereto a single propeller.

The present invention is generally designated by the reference numeral 20 in the figures and is seen to include a housing 21 having an inner chamber 23 having an opening 25 sized to receive the drive shaft 13 of the outdrive 10. The housing 21 also contains driven shafts 27 and 29 each of which has fixedly mounted thereon sprocket sets, 31 and 33, respectively (FIG. 3). A further sprocket set 35 is designed to mount over the drive shaft 13 of the outdrive 10 and to rotate in unison therewith.

Elongated chains 37, 42 drivingly connect the sprockets 35, 31 and 33 to transmit rotations of the sprocket 35 into direct rotations of the sprockets 31 and 33 in the same direction.

Figure 2:
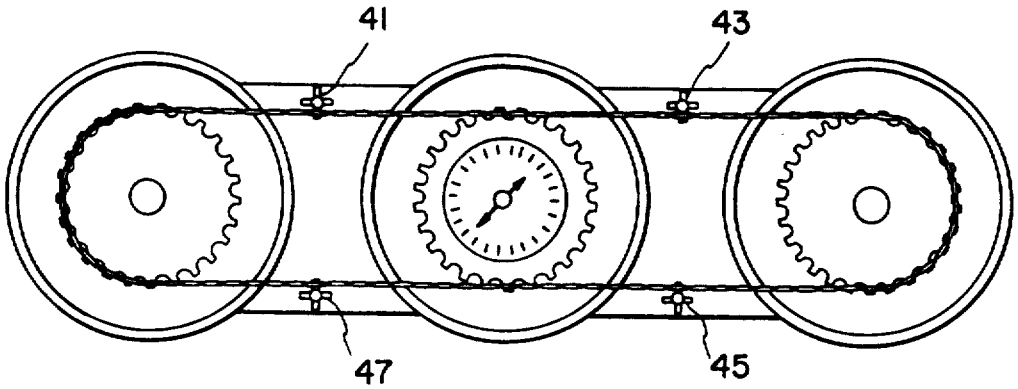
FIG. 2 shows a view from the same direction as the view of FIG. 1 but with the propellers and housing cover removed to show detail.

With particular reference to FIG. 2, it is seen that idler sprocket sets 41, 43, 45 and 47 each consisting of two axially spaced sprockets are provided to tension the chains 37, 42 to a sufficient degree to allow positive and sure transmission of power.

As best seen with reference to FIGS. 1 and 2, the housing 21 has a cover 22 which may be selectively removed to allow access to the interior chamber 23 of the housing to facilitate mounting of the sprocket 35 over the drive shaft 13. For this purpose, the sprockets of the sprocket set 35 have respective hubs 36 with a respective set screw 38 threadably received in an opening in each hub (not shown) so that each set screw 38 may be tightened into engagement with the drive shaft 13 to securely mount each sprocket thereon. If desired, the drive shaft 13 may be provided with a flat or, alternatively, the sprockets of the sprocket set 35 may be attached to the drive shaft 13 using the same structure which is used to affix a propeller thereto.

As seen in FIG. 1, the driven shaft 27 has a propeller 51 mounted thereon while the driven shaft 29 has a propeller 53 mounted thereon. The propellers are sized and configured in accordance with those factors taken into account by those skilled in the art in designing propellers in conjunction with the size of the vessel, the power output and speed of revolution of the engine thereof and other factors which are normally taken into consideration in propeller design.

As shown in FIG. 3, the inventive device 20 may be mounted on the outdrive 10 of the associated outboard through the use of U-shaped brackets, one of which is shown in FIG. 3 and designated by the reference numeral 61. The bracket 61 includes a straight portion 63 connected to two legs 65 and 67, which legs extend through openings in the housing 21 and have threaded ends. Respective nuts 69 and 71 may be tightened about the threaded regions of the legs 65 and 67, respectively, to fixedly clamp the device 20 onto the outdrive 10 of the associated outboard motor.

Through the use of the present invention, power which is normally transferred to a single propeller via the output shaft 13 may be, instead, transmitted to two separate propellers 51, 53 to cause power to be transferred into the water more evenly across the transom of the boat.

The present invention is disclosed in its simplest and most basic form. However, modifications could easily be made to cause the propellers to rotate in opposite directions. Thus, one of the shafts 27 or 29 could be coupled to a gear and meshed with a gear on an adjacent shaft with these gears having equal numbers of teeth to provide a one-to-one ratio, to reverse the direction of rotation of the output shaft.

Figure 4:
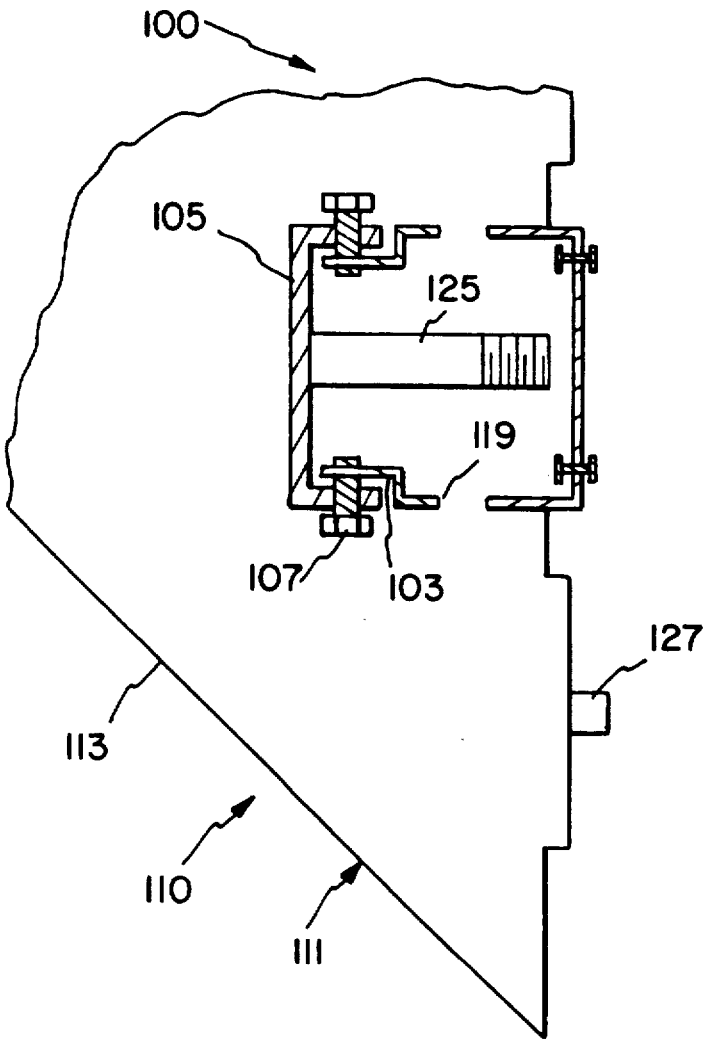
FIG. 4 shows an end view of an example of an alternative housing and device configuration.
Figure 5:
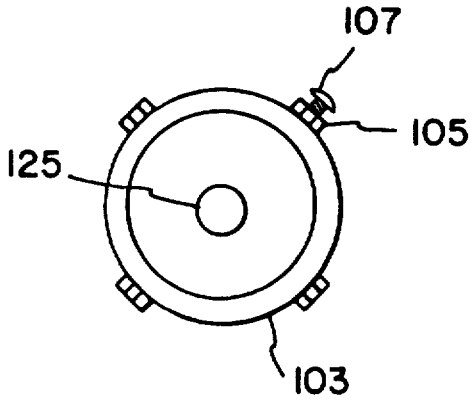
FIG. 5 shows a rear view of the mounting structure of FIG. 4.

FIGS. 4–5 show an alternative configuration of the inventive device generally designated by the reference numeral 110. Also shown is the drive shaft 125 from the associated outboard 100 including shaft housing 101 having a peripheral surface 103 gripped by a clamping mechanism 105 to mount the device 100 thereon. Set screws 107 hold the device 100 in place. The device 110 has a housing 111 having a sloping surface 113 configured to easily allow water to flow therepast, thus reducing resistance to movement of the associated vessel forward. Also shown in FIG. 4 is one driven shaft 127. The housing 111 has a slot 119 sized to allow one or more drive chains to extend therethrough to drivingly connect the drive shaft 125 with the driven shafts of which the driven shaft 127 is shown.

The clamping mechanism 105 is specifically designed to eliminate twist and vibration in the device 110 which might otherwise occur when the transmission of the associated outboard motor is engaged into gear and disengaged therefrom.

In a further aspect, the embodiments of the present invention may include gearing to allow rotation of the two propellers in opposite directions. Additionally, if desired, the invention may include means to allow changing of the gear ratio between the outboard output shaft and the driven shafts for various reasons including allowing higher engine speeds, decreasing the time it takes for the associated vessel to go "on plane", etc.

As such, an invention has been disclosed in terms of a preferred embodiment thereof which fulfills each and every one of the objects of the invention as set forth hereinabove and provides a new and useful self-contained outboard twin propeller adaptor of great novelty and utility. Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. In an outboard motor having an outdrive and a drive shaft, the improvement comprising a self-contained twin propeller adaptor, comprising:

(a) a housing having an internal chamber;

(b) a drive sprocket and first and second driven sprockets drivingly connected by a closed drive chain, said chain extending generally linearly from said first driven sprocket to said drive sprocket to said second driven sprocket;

(c) a first driven shaft connected to said first driven sprocket and extending outside said housing;

(d) a second driven shaft connected to said second driven sprocket and extending outside said housing;

(e) a propeller attached to each said driven shaft;

(f) said adaptor being mounted directly on said outdrive of said outboard motor with said drive shaft thereof being drivingly connected to said drive sprocket.

2. The invention of claim 1, further including an access cover allowing access to said internal chamber in an area where said drive sprocket is located.

3. The invention of claim 1, wherein said adaptor is mounted on said outdrive with at least one clamp encircling said outdrive and bolted to said housing.

4. The invention of claim 1, further including a plurality of idler sprockets in said chamber and engaging said chain to tension said chain.

* * * * *